US005425299A

United States Patent [19]

Teetzel

[11] Patent Number: 5,425,299

[45] Date of Patent: Jun. 20, 1995

[54] LASER MODULE AND SILENCER APPARATUS

[76] Inventor: James W. Teetzel, 14 Stratham Green, Stratham, N.H. 03885

[21] Appl. No.: 89,889

[22] Filed: Jul. 12, 1993

Related U.S. Application Data

[63] Continuation-in-part of Ser. No. 73,766, Jun. 8, 1993.

[51] Int. Cl.[6] ..... F41A 21/30

[52] U.S. Cl. ..... 89/14.4; 42/103; 42/1.05; 42/1.02

[58] Field of Search ..... 89/14.4, 14.05; 42/103, 42/1.05, 1.03, 1.02; 362/110, 113, 114

[56] References Cited

U.S. PATENT DOCUMENTS

| | | | |
|---|---|---|---|
| 1,482,805 | 2/1924 | Maxim | 89/14.4 |
| 2,464,010 | 3/1949 | Vonella | 89/14.05 |
| 4,479,418 | 10/1984 | Beretta | 89/14.4 |
| 4,934,086 | 6/1990 | Houde-Walter | 42/103 |
| 5,052,138 | 10/1991 | Crain | 42/1.02 |
| 5,136,924 | 8/1992 | Forster et al. | 89/14.4 |
| 5,142,805 | 9/1992 | Horne et al. | 42/1.02 |

FOREIGN PATENT DOCUMENTS

| | | | |
|---|---|---|---|
| 4022038 | 1/1992 | Germany | 42/1.03 |

*Primary Examiner*—Stephen M. Johnson
*Attorney, Agent, or Firm*—William B. Ritchie

[57] ABSTRACT

A silencer apparatus that can be attached to a standard autoloading handgun having a laser sight module mounted to the front face of the slide of the handgun. The silencer module features additional electronics so that the firing status of the firearm can be ascertained. A skid plate protected switch in the magazine compartment of the handgun provides information as to whether a new clip has been inserted. A flash detector located within the silencer counts the rounds fired and provides a digital read-out of remaining rounds to be fired. Also, the accumulated fired rounds is provided to enable the user to know when the silencer needs cleaning. Noise reduction is provided by a metal honeycomb.

11 Claims, 17 Drawing Sheets

LASER MODULE AND SILENCER APPARATUS

This application is a continuation-in-part of U.S. patent application Ser. No. 08/073766, filed Jun. 8, 1993 still pending.

BACKGROUND OF THE INVENTION

1. Field of the Invention

The invention relates to laser sights and silencers for use on small firearms, particularly semi-automatic handguns.

2. Description of the Related Art

It is well known that even skilled marksman with a handgun have been unable to hit a target as close as 7 meters when attempting to draw the weapon and fire at speed. In target shooting, the shooter must obtaining the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, the trigger, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances and substantial lower, accuracy is still vital. Law enforcement official are instructed to fire only as a last resort, cognizant of the fact that their intended target will mostly be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet where millimeters can mean the difference between death and survival cannot be known a priori by the even the most skilled marksman.

Mechanical sights have limited value in many situation where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstance, the officer must reach around his/her shield or other barricade and instinctively aim and fire his/her gun with the handgun in a very different orientation that would be experience if fired from a standing, drawn from a holster position. Small changes in barrel orientation due to the sight radius of the typical law enforcement handgun can produce substantial errors relative to the target. Accurate instinctive shooting is not considered practical beyond 20 feet for the average shooter.

A solution to this problem has been the introduction of laser sights for use with handguns. The typical laser sight is mounted on the top on the handgun or on the bottom. The laser sight when properly aligned, places a red light dot on the target where the bullet will strike if the gun is fired. Using this type of sight, enables the law officer to rapidly instinctively properly position the weapon and be certain of his/her intended target. Using a laser sight enables accurate shots to be fired at distances of more than 50 feet, sufficient for most combat law enforcement situations requiring the use of handguns.

U.S. Pat. No. 4,934,086, issued to Houde-Walter on Jun. 19, 1990, discloses installing the laser sight within the recoil spring guide. The use of the recoil spring guide to house the laser sight components enables the firearm to be holstered in a normal manner. The use of the spring recoil guide presents alignment problems to ensure accuracy. In other words, the laser within the recoil guide is difficult to align with the barrel of the firearm. Therefore, misalignment of the sight resulting in poor accuracy is likely.

However, prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. Also, since prior art laser sights are very bulky in comparison to traditional mechanical sights, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun, easily and accurately adjustable, is not disclosed in the prior art.

The use of silencers to reduce the velocity of the gasses that issue from the muzzle of a gun when fired is well known. The principle behind all of these devices is providing a tortuous path for the powder gases. Generally, such devices are attached to the barrel of the weapon, which is typically a handgun. One major problem with such devices is the size of the device interferes with front sight of the handgun. This requires the use of auxiliary sights that must be mounted on the silencer and at the rear of the firearm.

Representative of the art is U.S. Pat. No. 5, 136,923, issued to Walsh on Aug. 11, 1992. This reference discloses the use of an interior tube with a plurality of ports leading to chamber having packing material.

U.S. Pat. No. 5,136,924, issued to Forster on Aug. 11, 1992, discloses a silencer for use with pistols with a fixed or tilting barrel. This design features a cross-sectional profile that enables the shooter to use the standard sights.

U.S. Pat. No. 5,029,512, issued to Latka on Jul. 9, 1991, discloses still another silencer. This design uses a plurality of annular baffles,defining a spiral path to reduce the noise of the discharged firearm.

U.S. Pat. No. 5,142,805, issued to Horne at al. discloses a counter for calculating the number of rounds remaining in the firearm. This device receives input from a slide switch and a magazine switch. This device is not suitable for use with a silencer since silencer use generally requires the automatic slide aspect of the handgun to be disabled. This is done to eliminate the noise that is present when the carriage slide blows back after the round is fired in order to place a new round in the chamber.

A silencer that is designed to be used with a laser sight or having integral flashlight and gun status displays is not found in the prior art. A cartridge monitor that displays the firing status of a firearm that can be used with a laser sight in combination with a silencer is also not found in the prior art.

SUMMARY OF THE INVENTION

It is an object of the invention to provide a silencer that is adapted to be attached to a laser module sight apparatus that fits within the profile framework of the handgun.

It is another object of the invention to provide a silencer that counts the number of rounds as they being fired so that the shooter will always know the number of rounds left to fire.

It is still another object of the invention to provide a silencer that tells the user when the silencer must be cleaned after a pre-determined number of rounds has been fired.

It is still another object of the invention to provide a silencer that tells when the batteries need to be replaced.

It is another object of the invention to provide a silencer that indicates a spent cartridge is in the firing chamber of the firearm.

It is another object of the invention to provide a silencer capable of emitting either a red or infrared laser beam from the front face of the silencer.

It is another object of the invention to provide a silencer that has a built-in flashlight that can shine a beam of light from the front face of the silencer.

It is another object of the invention to provide a laser module sight and silencer combination that is extremely light compared to existing lasers and their mounts.

It is still another object of the invention to provide a laser module sight and silencer combination that provides information from the sight module to the silencer or from the laser module to the autoloading handgun via light emitting diodes.

It is another object of the invention to provide a laser module sight and silencer combination that can be powered by commercially available batteries, providing at least several hours of service time before needing to be changed.

It is another object of the invention to provide a silencer that utilizes a metal honeycomb material as the major component of the baffling system.

It is another object of the invention to provide a silencer that incorporates a programmable firearm status processor accessible by membrane switches.

It is another object of the invention to provide a laser module sight that has controls on either side of the firearm so that the controls are convenient for either left-handed or right-handed shooters.

The invention is a combination laser sight and silencer for autoloading handgun, said handgun having a barrel and a spring recoil guide, a trigger, a frame, a slide having a cross-sectional profile with a front face having two holes therein, with one hole corresponding to the diameter of the barrel and the other hole corresponding to the diameter of the spring recoil guide. The laser sight comprises a chassis, having a cross-sectional profile corresponding to the cross-sectional profile of the slide of said handgun, said chassis having a front face, a back face, and having two holes extending therethrough from the back face to the front face of said chassis, with the holes corresponding to the holes in the front face of the slide of said handgun, with said chassis having at least one light source wherein the light of said light source is emitted from the front face of said chassis, and with the back face of said chassis securely mounted on the front face of the slide of said handgun. The silencer is attached to the laser sight module which is attached to said handgun. An attachment face is provided. The attachment face of the silencer has a cross-sectional profile corresponding to the cross-sectional profile of said laser sight module. Also, the attachment face has a first opening corresponding to the barrel of said handgun, a second opening corresponding to the spring recoil guide of said handgun, a third opening for light communication between said laser sight module and said silencer. Additionally, the attachment face has at least one diode opening to allow laser diode light produced by said laser sight module to shine therethrough. A microprocessor that is optically connected to said laser sight module and said handgun is provided. Said microprocessor produces a first output signal corresponding to the number of rounds left to fire in the magazine of said handgun, a second output signal that corresponds to an accumulative total of rounds fired through said handgun, a third output signal that corresponds to whether a cartridge is present within the firing chamber of said handgun, a fourth output signal that corresponds to whether a cartridge within the firing chamber of said handgun has been fired. Means for substantially reducing the noise associated with the firing a cartridge in said handgun is provided.

DETAILED DESCRIPTION OF THE INVENTION

Figure 1:
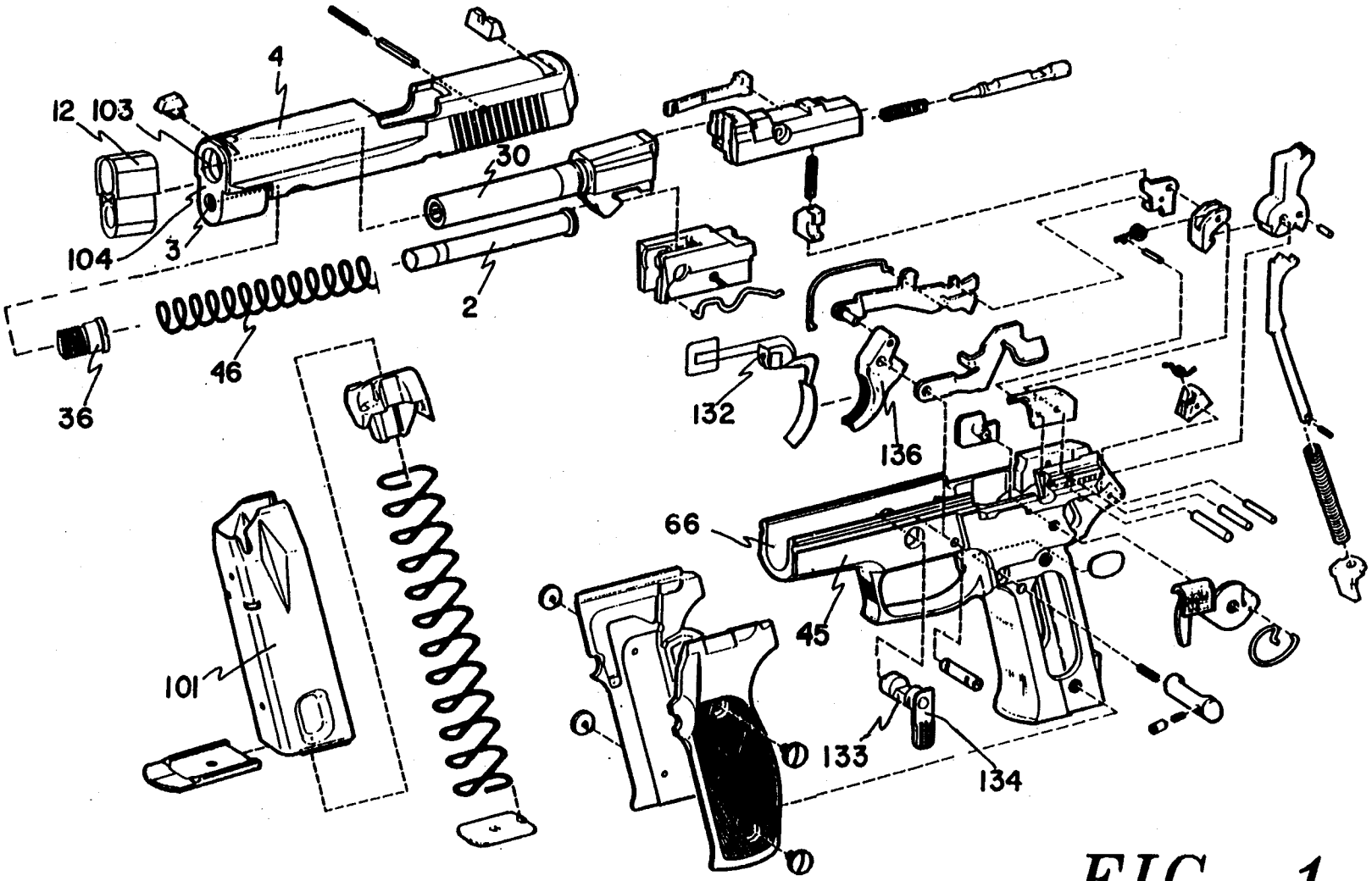
FIG. 1 is a breakdown view of typical autoloading handgun, in this, the SIG Model P228.

FIG. 1 is breakdown view of a typical autoloading handgun which can be adapted to incorporate a concealed laser module sight in accordance with the invention. The pistol shown is SIG-SAUER Model P228, 9 mm, with a 13 cartridge clip or magazine 101. This particular pistol has been adopted by numerous military and law enforcement agencies as the weapon of choice because of its large magazine capacity, reliability, and accuracy. In operation, slide 4, guided by recoil spring guide 2 and tensioned by recoil spring 46, is slid backwards along frame 45, tensioning recoil spring 46. Barrel 30 and recoil spring guide 2 extend through barrel hole 103 and recoil spring guide hole 3 respectively. Once slide 4 is released, spring 46 causes slide 4 to move forward, strip a round (not shown) from magazine 1 01, and place the cartridge into the firing chamber of barrel 30. When slide 4 is in its most forward position on frame 45, recoil spring guide 2 and barrel 30 are substantially flush with front face 104 of slide 4 via their respective holes 3 and 103.

Some autoloading handguns, such as the Colt Government Model 45 (not shown), incorporate a barrel bushing that positions barrel 30 within barrel hole 103 of slide 4. The barrel bushing in that model extends slightly beyond the front face 104 of slide 4. Other, such as the S & W Model 39, incorporate a barrel bushing that also acts as a bushing for recoil spring guide 2. The S & W bushing occupies a substantial portion of the front face 104 of slide 4. However, the invention can be adapted to fit any autoloading handgun by merely making minor changes as will be shown later.

Figure 2:
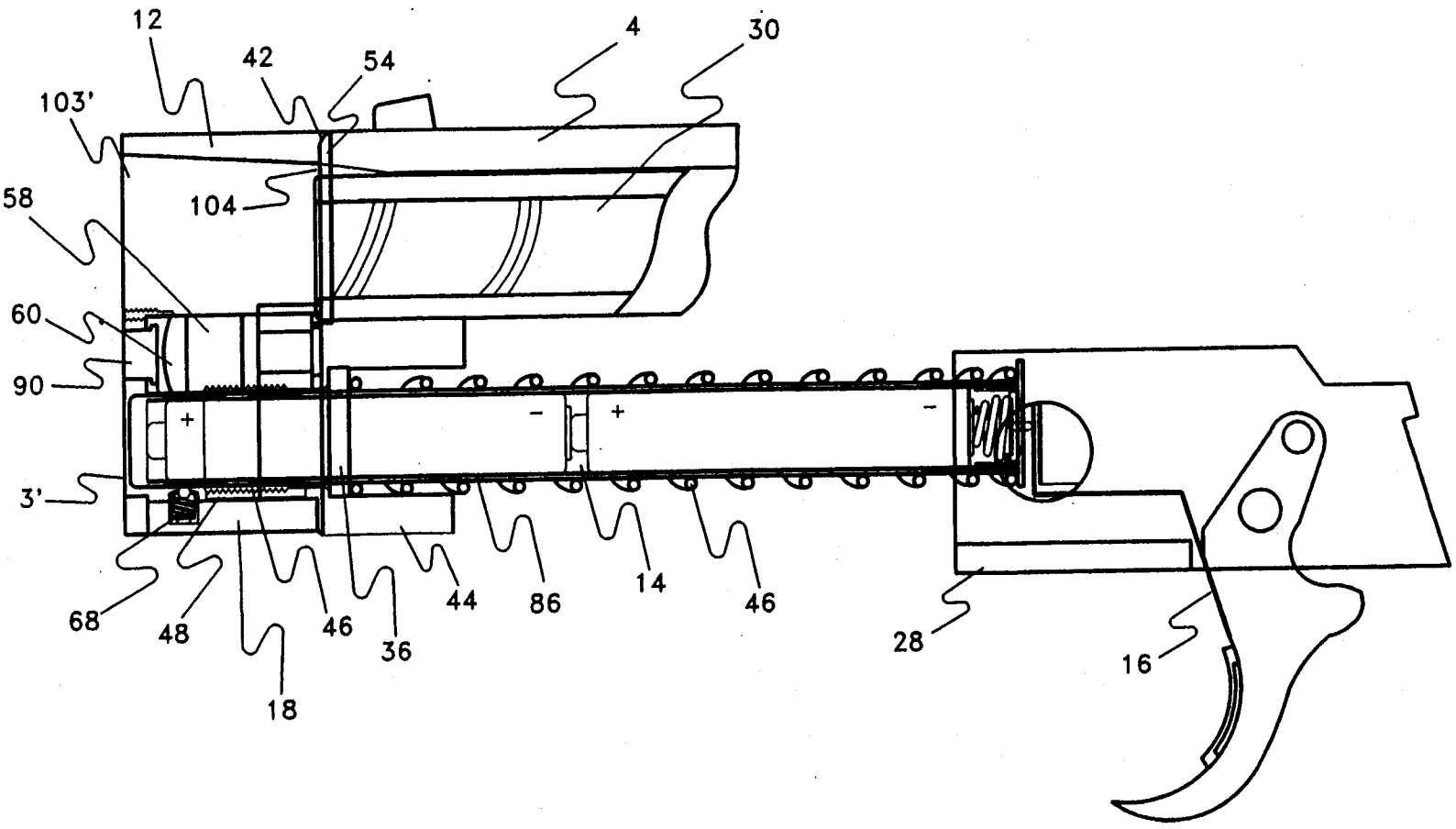
FIG. 2 is a cross-sectional view of the laser diode sighting system attached to the autoloading handgun shown in FIG. 1 in accordance with the invention.

The invention takes advantage of the basic design of this type of firearm. Recoil spring guide 2 is modified to house a concealed battery compartment to power a laser that is mounted in a chassis, adapted to be attached to the front face 104 of slide 4. Further, the chassis is provided with holes corresponding to barrel hole 103 and spring recoil guide hole 3 so that the normal functioning of the firearm does not have to altered. This enables the handgun to function in every respect the same as a firearm not equipped with laser sight if the sight is not turned on. Yet, when the laser sight is needed, the invention is easily activated by a conveniently placed switches will be discussed below. FIG. 2 is a cross-sectional view of the laser diode sighting system 10 attached to the autoloading handgun shown in FIG. 1 in accordance with the invention. The laser diode sighting system 10 has five subsystems, laser diode chassis 12, retaining bushing 36, membrane switch 18, recoil spring guide battery pack 14 and the trigger switch 16. The laser diode chassis 12 is dimensioned to have the same profile as slide 4. Chassis 12 also has holes 103' and 3' that correspond to barrel hole 103 and spring recoil guide hole 3. Since the barrel 30 of the Sig Model P288 tilts upward when slide 4 is in the fully retracted position, hole 103' is modified accordingly. Also, hole 3' is dimensioned to allow recoil spring guide 2 to slide through when slide 4 travels backwards.

Since system 10 mounts on the front face 104 of slide 4, little modification of the handgun is required. The major internal modification is replacing the standard spring recoil guide 2 with battery pack 14.

Chassis 12 is held in place on front face 104 by means of retaining bushing 36. As shown, chassis 12 mounts on the front slide face 104 of the slide 4. Retaining bushing 36 extends from the inside the spring housing 44 of the slide 4 out through the recoil spring guide hole 3 where as the threads 46 extended out, screw into the chassis threaded hole 48 in chassis 12. Bushing 36 has an opening 51 that corresponds to diameter of battery pack 14 so that battery pack 14 may easily slide therethrough.

Figure 3:
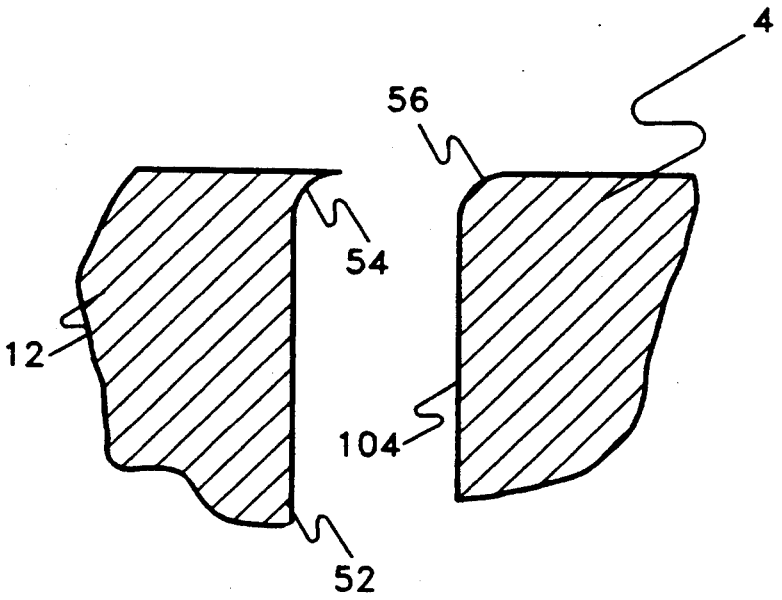
FIG. 3 is a detailed cross-sectional view of the sighting system chassis locked to the slide of the typical handgun.

Bushing 36 holds the back surface 52 of chassis 12 snug against the front slide face 104 of the slide 4. As shown in the detail FIG. 3, locking radiuses 54 prohibit the laser diode chassis 12 from rotating by matching with radius 56 on front of slide 4. This is a preferred method. Other methods may be by gluing, pinning, notching, etc. depending on the configuration of the front face 104 of slide 4. For example, for handguns that use a barrel bushing, a second bushing may be used in addition to bushing 36 or in lieu of, to hold chassis 12 firmly in place.

Laser diode chassis 12 is preferably made of a heat treatable steel material. This would make a more durable housing to resist against damage. However, other materials for chassis 12 are also suitable such as hard plastic and aluminum.

Lens protector 90 will be glued in from the inside of the laser diode chassis 12. Lens protector 90 is preferably made of material that is clear to allow a light beam to travel through it without distorting it and will resist flash burns, residue, abrasion and keep water and dirt from getting into the laser diode chassis 12. Clear glass would be a preferable material.

Figure 4:
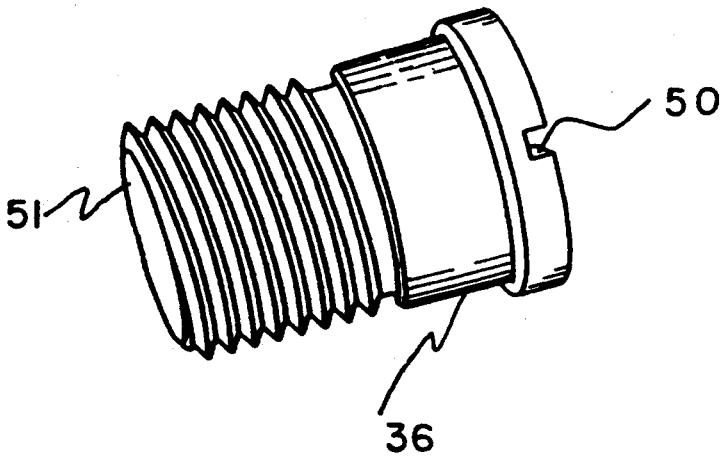
FIG. 4 is a detailed isometric view of the chassis bushing.

As shown in FIG. 4, retaining bushing 36 is preferably made of a high tensile stainless steel that resists cracking. Slot 50 in retaining bushing 36 allows for ease of installation with a screwdriver.

Figure 5:
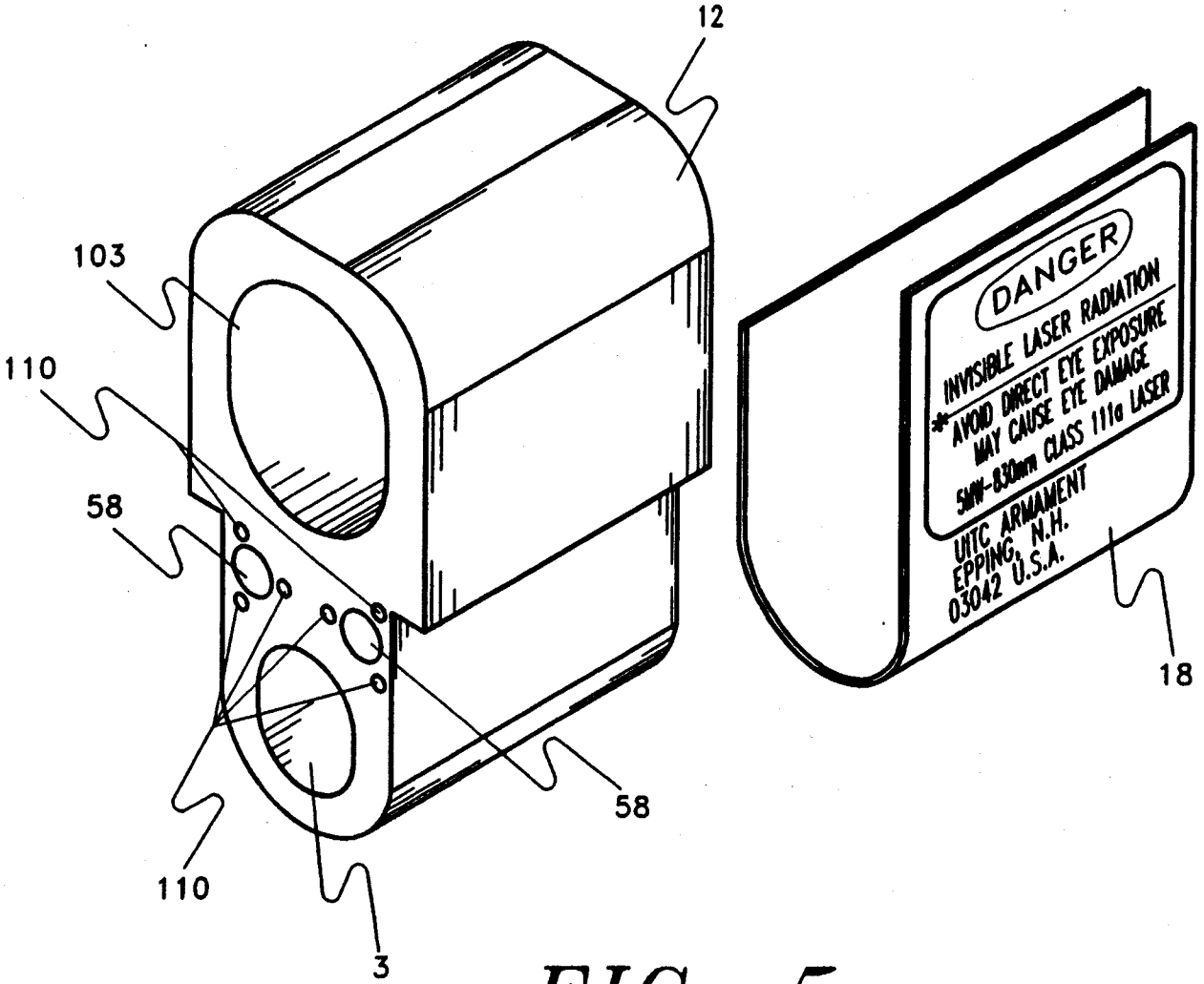
FIG. 5 is a front isometric view of chassis.

FIG. 5 is a front isometric view of chassis 12 and membrane switch 18. Chassis 12 houses one or more laser diode lights 58 with a collimating lens 60 (shown in FIG. 2). Laser diode light 58 with a collimating lens 60 is preferably the type manufactured by Roam or Lyte Obtronics. It should be recognized that light 58 could also be a standard incandescent bulb to act as a flash light. The laser diode light 58 with a collimating 60 can be positioned anywhere on the face 64 of the chassis. However, the preferable placement is as shown with one light opening 58 emitting a red beam and the other light opening 58 emitting an infrared beam to be detected by night vision goggles.

The precise positioning of lights 58 can be manipulated by turning in and out three socket head set screws 110 equally spaced located on face 64. Socket head set screws 110 are preferably 2-56 UNEF socket head set screw modified with chamfer. This allows wedging along surface light 58 thereby aligning laser diode light 58 with collimating lens 60 in relation with barrel 30. The preferred method of mounting the chassis to the slide limits the amount of stack-up tolerances in relation to the laser diode and the center line of the barrel, whereas, prior art devices mount the diode in other locations, such below the slide or in the recoil guide, which may substantially effect the accuracy of the sighting apparatus.

By enabling the shooter to easily adjust alignment of the laser diode light 58 in relation with the barrel, the shooter can reflect his/her personal shooting habits such as pulling the pistol to one side when the trigger is pulled.

Referring again to FIG. 2, laser diode 58 with a collimating lens 60 could also be positioned off from the centerline of the barrel 30 and reflected out of light opening by using a prism.

The exact placement and orientation of the laser diodes within chassis 12 and light openings 58 can be varied as long as face 64 of chassis 12 does not extend greater than the face 104 of slide 4. When the gun is fired, and it recoils, the slide 4 travels backward with the frame 45 as is shown in FIG. 1. Clearance is required between chassis 12 and cavity 66 of frame 45.

Figure 6:
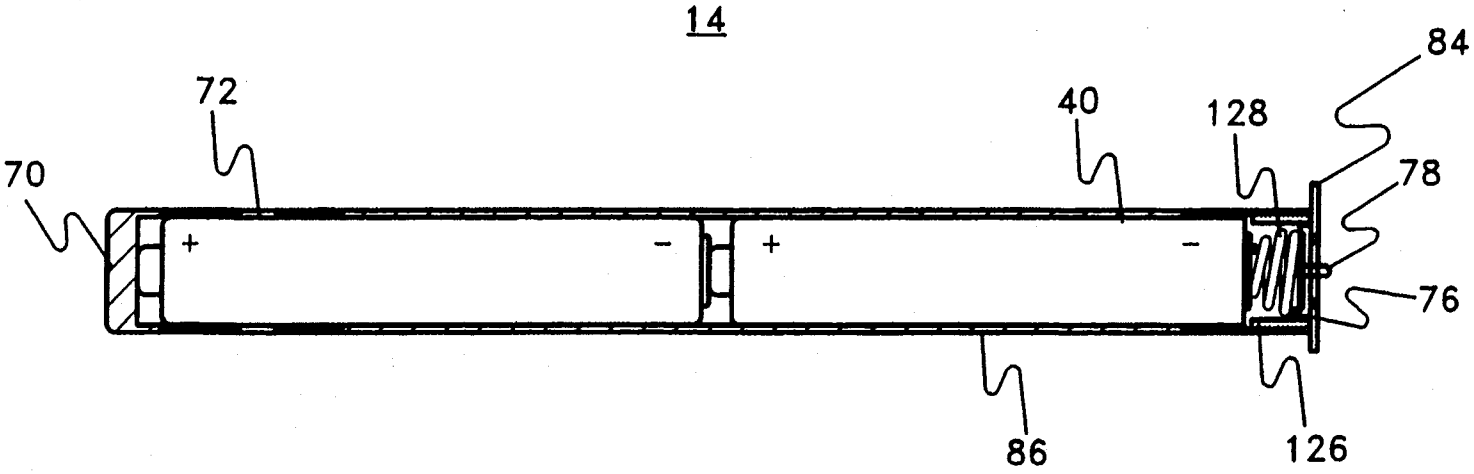
FIG. 6 is a cross-sectional view of the battery pack.

Referring now to FIGS. 6, the details of battery pack 14 and its operation will be presented. The invention requires a recoil spring guide battery pack 14 to energize the laser diode chassis 12. Battery pack 14 is electrically connected to frame 45 via spring-loaded electric contact pin 68 as shown in FIG. 2. Spring-loaded electric contact pin 68 is required so that when the gun is fired and the slide 4 with the laser diode chassis 12 attached will ride along the surface housing 86.

Pin 68 is the preferred method, however, a roller, or a deformed piece of metal could be used to contact the front cap 70 of the recoil spring guide battery pack 14. The electric operation requires the gun to become the ground or negative charge. This is accomplished by having a battery insulator 72, insulate the positive charge from the main housing 86 of the recoil spring battery pack 14. The negative charge of the recoil spring battery pack 14 is insulated in the same fashion.

Battery pack 14 has a front cap 70 preferably a heat treated steel, that is bonded to a non conductive material preferably black DELRON or ABC polymer plastic material called battery insulator 72. The battery insulator 72 is then bonded to the main housing 86. Preferred material is heat treated steel. The wall thickness is relatively thin to minimize the overall diameter of the recoil spring guide battery pack 14.

Two 1½ volt batteries 40 preferably EVERREADY E96VP will be replaceable by unscrewing spring cap 126 from main housing 74. The spring cap 126 will house the aft insulator 76, a contact point 78 preferably brass that is tin plated to prevent corrosion, and a spring 128. The spring 128 takes up whatever distance there may be caused by manufacturing tolerances of the AAAA battery 40. Spring 128 will be attached to contact point 78 by soldering as preferred method. Spring 128 also serves as a shock absorber to counter the recoil shock when the firearm is discharged.

Contact point 78 will be bonded to aft insulation 76 using epoxy as preferred method. Aft insulation 76 will be bonded to spring cap in a similar fashion.

This is insulated by aft insulation 76 allowing only for the main housing 86 to have a negative charge when the trigger switch is activated.

Figure 7:
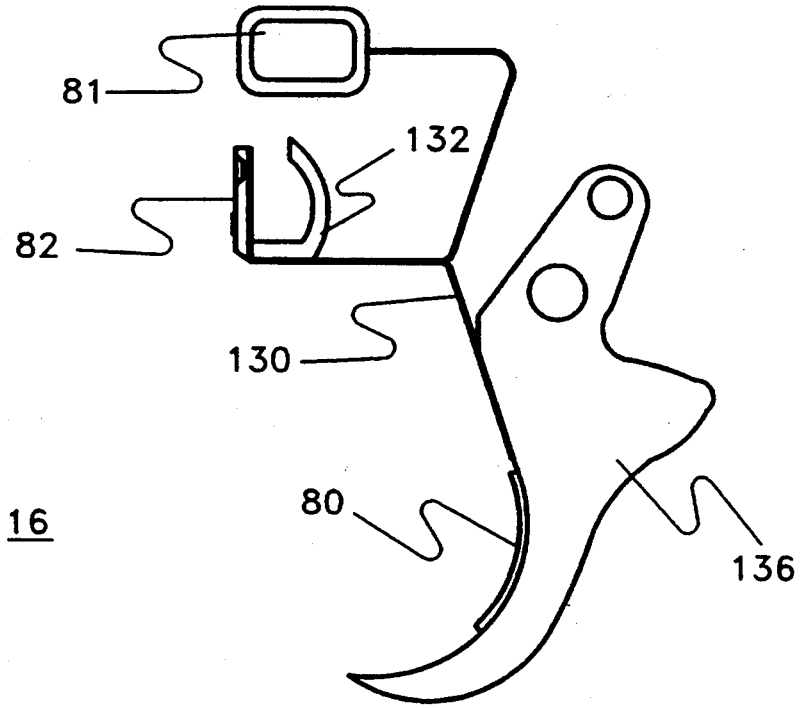
FIG. 7 is a detailed view of the trigger switch.

Referring now to the FIG. 7, the contact point 78 allows for a circuit to be complete when the laser is activated by depressing trigger membrane switch 80 on trigger 136. A closed circuit is present across face 82. Face 82 then creates a circuit through surface contact 84 (shown in FIG. 6). This is a preferred method of switching. There are many other ways by means of switching using a phototransducer/LED switch, a transmitter/receiver, etc.

As shown in FIG. 7, trigger switch 16 is a membrane switch with electric terminals 130. The pad 82 will be bonded to the take down retainer 132 with the preferred method of bonding being epoxy. The take down retainer 132 snaps in the cavity 133 of take down lever 134 (shown in FIG. 1) with the loose electric terminal 130 it allows the shooter to rotate the take down lever 134 to strip the slide 4 from the frame 45. This is a normal operation to clean the gun. The pad 80 is bonded to the trigger 136 using a sticky backed paper. Pad 80 is a pressure sensitive switch which is in the "on" condition when the shooter presses pad 80 and is in the "off" when released.

A second pad 81 can be mounted to frame 45 so that sight 10 can be activated without the shooter placing a finger on the trigger 136. The placement of pad 81 will depend on whether the shooter is right or left-handed. Pad 81 can also activate sight 10. However, when pad 81 is released, a slight delay, supplied by membrane switch 18, occurs before the sight is shut-off, thus giving the shooter time to activate the sight using pad 80. This prevents the shooter from losing his/her sight picture of the target in the brief time it takes for the shooter to move his/her finger from pad 81 to pad 80.

Figure 8:
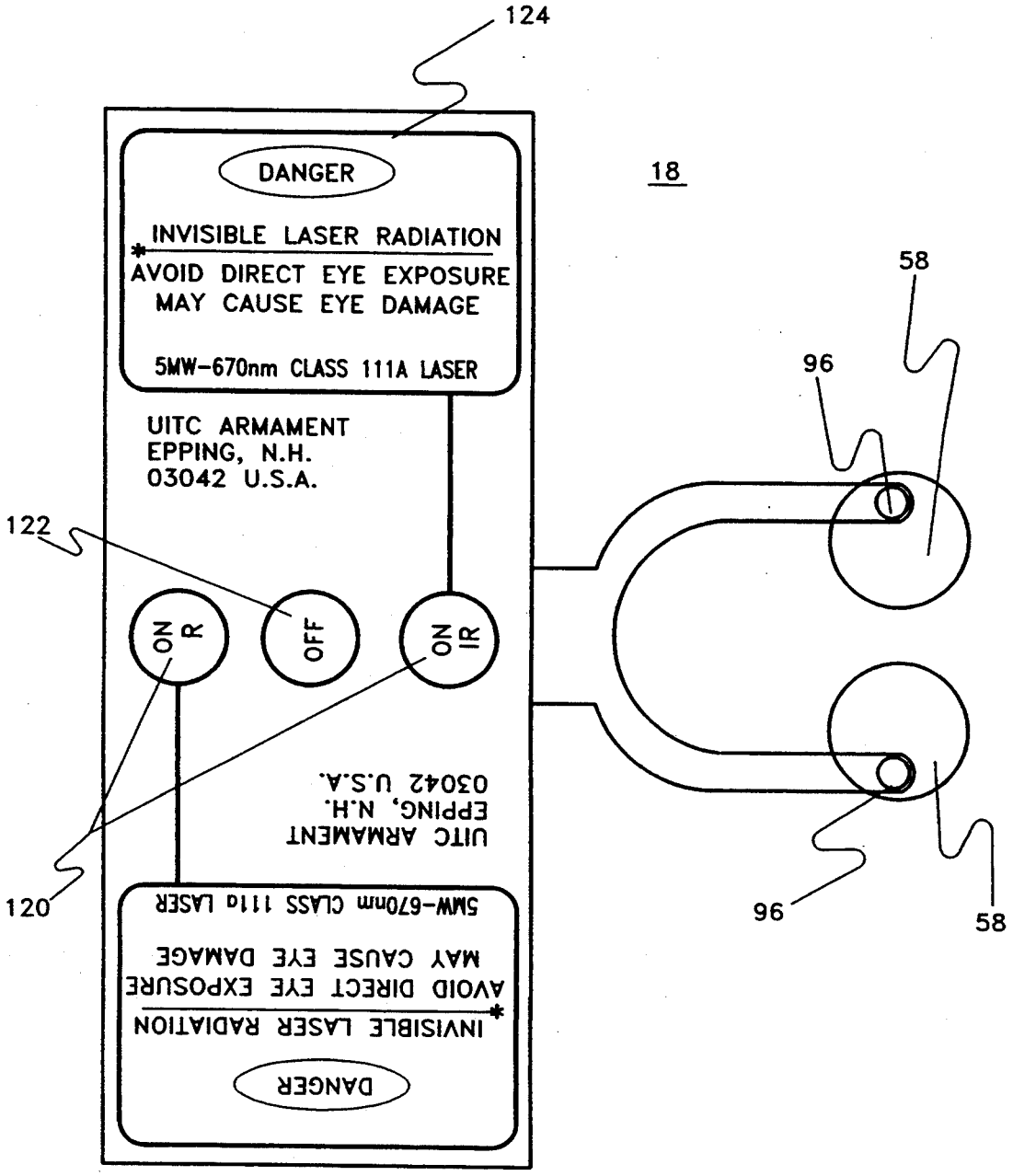
FIG. 8 is a detailed flattened view of the membrane control switch.

FIG. 8 is a detailed flattened view of the membrane control switch. Membrane control switch 18, preferably made of shock resistant plastic molded chassis with built-in switching circuitry such as manufactured by SPECTRA SYMBOL. Membrane switch 18 acts as an electrical circuit to energize and control the infrared and/or visible laser. On buttons 120, and off buttons 122 allow the shooter to preselect an environmental condition or switch hit back, if the shooting conditions change. Membrane switch 18 also accommodates laser warning labels 124 as shown. Membrane switch 18 provides connection to laser diode 58 via electrical contacts 96. Membrane switch 18 is preferably bonded to chassis 12 using epoxy.

Figure 9:
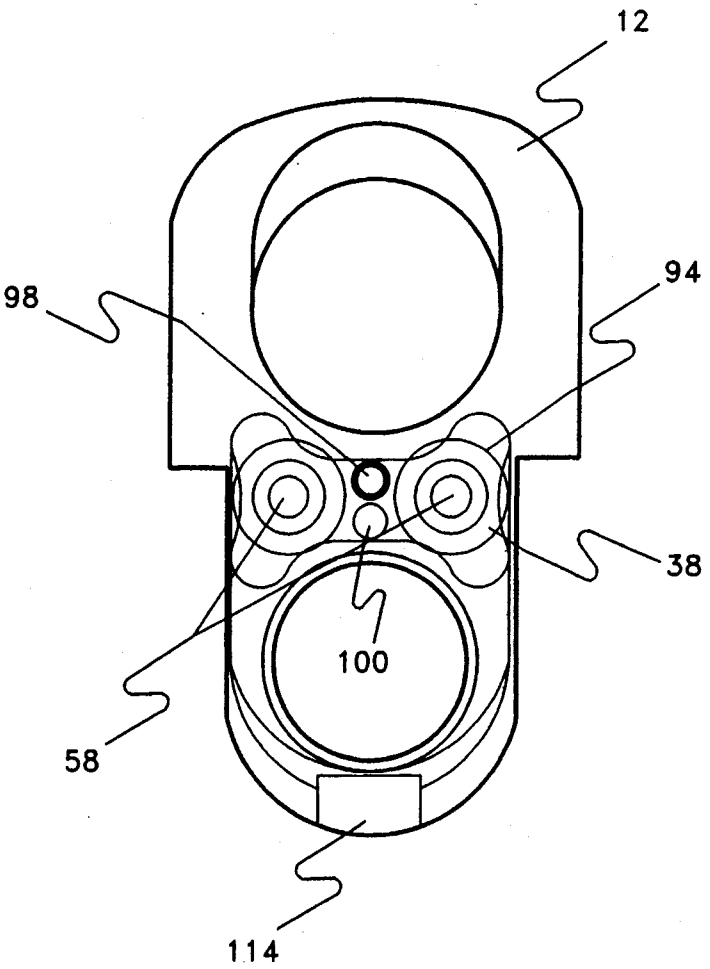
FIG. 9 is rear view of the chassis showing the retainer member in place.

FIG. 9 is rear view of chassis 12 showing the retainer 38. The "dog bone" shaped retainer 38 is preferably made of heat treatable steel will be fastened down by a socket head cap screw 98 and a locating pin 100. The purpose of retainer 38 is to hold diode 58 in place in chassis 12 (shown in outline) and to ensure that a good electrical contact is made. Pocket 114 will allow a space for the membrane switch 18 to lay into when assembled.

Figure 10:
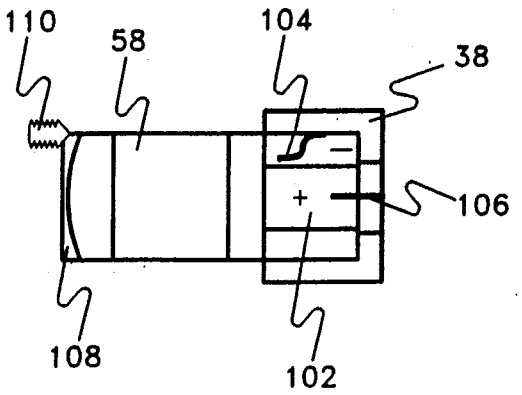
FIG. 10 is cross-sectional view of the laser module assembly within the chassis.

Referring now to FIG. 10, laser diode light 58 will have one negative lead 104 that will ground to retainer 38 on surface 94 (shown in FIG. 9) and a positive lead 106 that will contact with switch contact 96 of membrane switch 18 (shown in FIG. 8) when assembled in place. Retainer 38 will also allow the back end 102 of the laser diode light 58 to pivot when adjusted using alignment screws 110.

Figure 11:
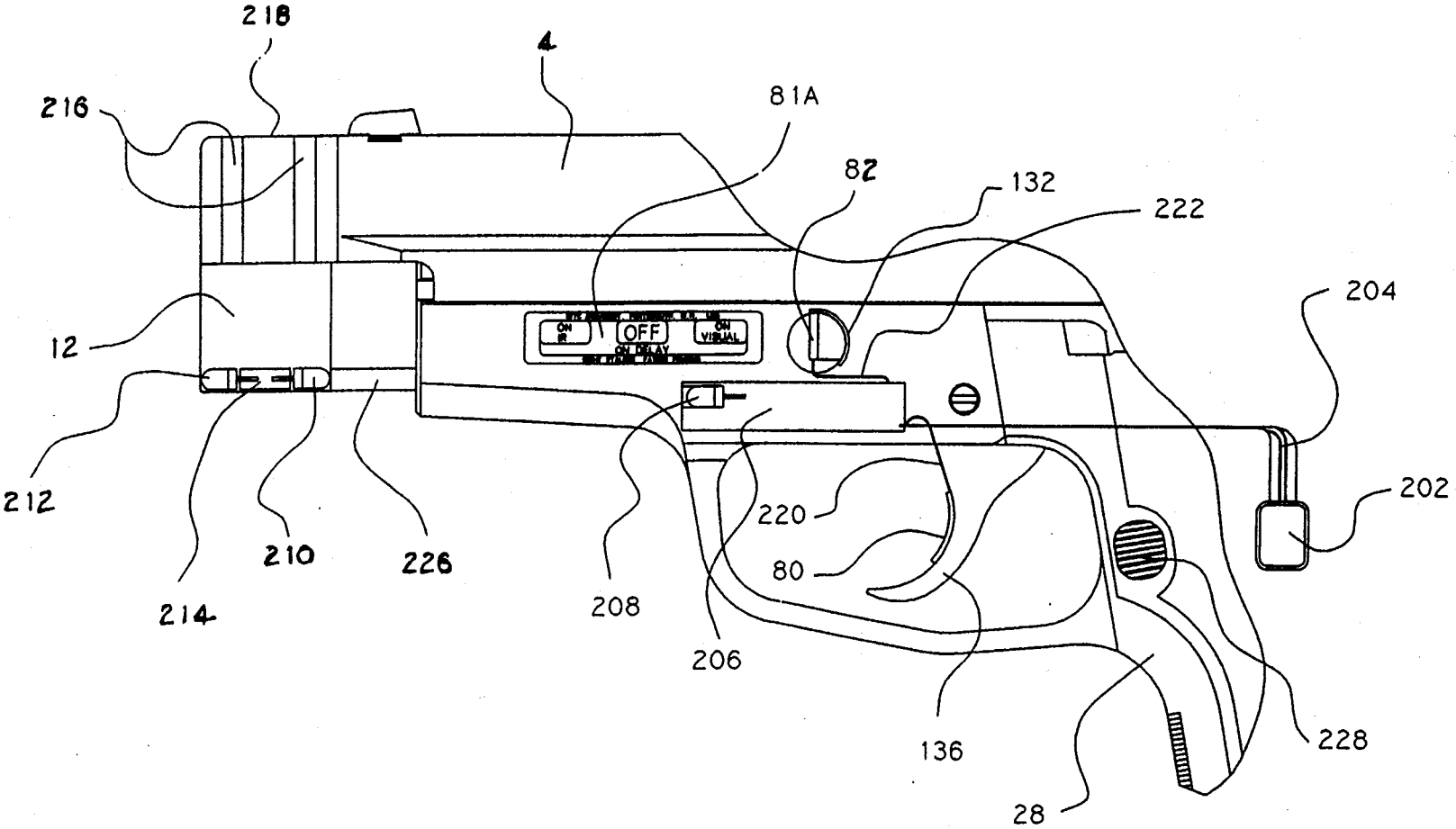
FIG. 11 is a side elevation with cut-away views of an alternative embodiment of the laser sighting system modified to accommodate the use of silencer.

FIG. 11 is a side elevation with cut-away views of an alternative embodiment of laser sighting system modified to accommodate the use of the silencer invention. Magazine sensor switch 202 is located within the magazine housing. Switch 202 is activated when the magazine (not shown) is removed from the firearm. Switch 202 is preferably a membrane switch with a metal skid plate to protect the surface from abrasion. Switch 202 is connected to control box 206 via wire 204. Control box 206 houses a microprocessor, preferably the type manufactured by Exel of San Jose, Calif., identified as their $E^2$ PROMs. Also included in box 206 is LED 208. LED 208 signals detector 210 via hole 226. LED 208 is preferably made by ROHM, product no. SIR 381SB3. Detector 210 is preferably ROHM's model RPT-38PB3. Hole 226 must be placed in the firearm. LED 208 provides the following information to detector 210: which laser light . . . infrared, red is on or whether the laser sighting system is off, whether the left or right frame switch 81A is being used, status of magazine via switch 202 and, finally, the status of trigger switch 80.

In this embodiment frame switch 81 a is modified to include the controls provided in switch 18. Switch 18 is not used. The information obtained from detector 210 is provided to microprocessor 214. Microprocessor 214 is preferably an Exel $E^2$ PROM. Microprocessor 214 will turn on either laser diode 58 infrared or red. Microprocessor 214 also activates emitter 212. Emitter 212 communicates with the silencer which will be discussed below.

Chassis 12 is fitted with grooves 216 which provide an anchoring point for the silencer. Grooves 216 are preferably about ⅛ wide and 1/16 deep. Top 218 of chassis 12 mates with the silencer.

Figure 12:
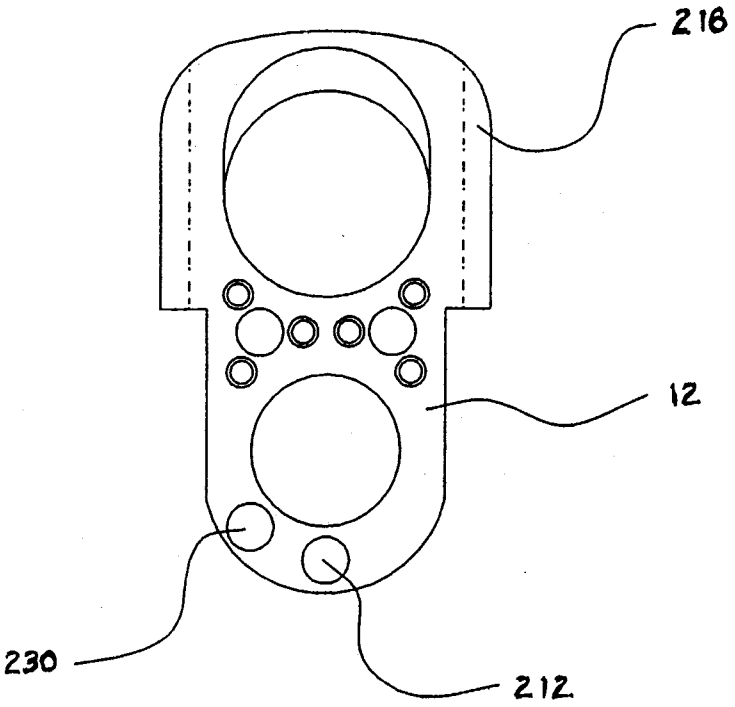
FIG. 12 is a front view of the laser sight chassis of FIG. 11.

FIG. 12 is a front view of the laser sight chassis of FIG. 11. Chassis 12 is modified with pin receiver opening 230 which is dimensioned to receive a pin locking member from the silencer. Grooves 216 are precision ground to provide a secure anchoring point for the silencer.

Figure 13:
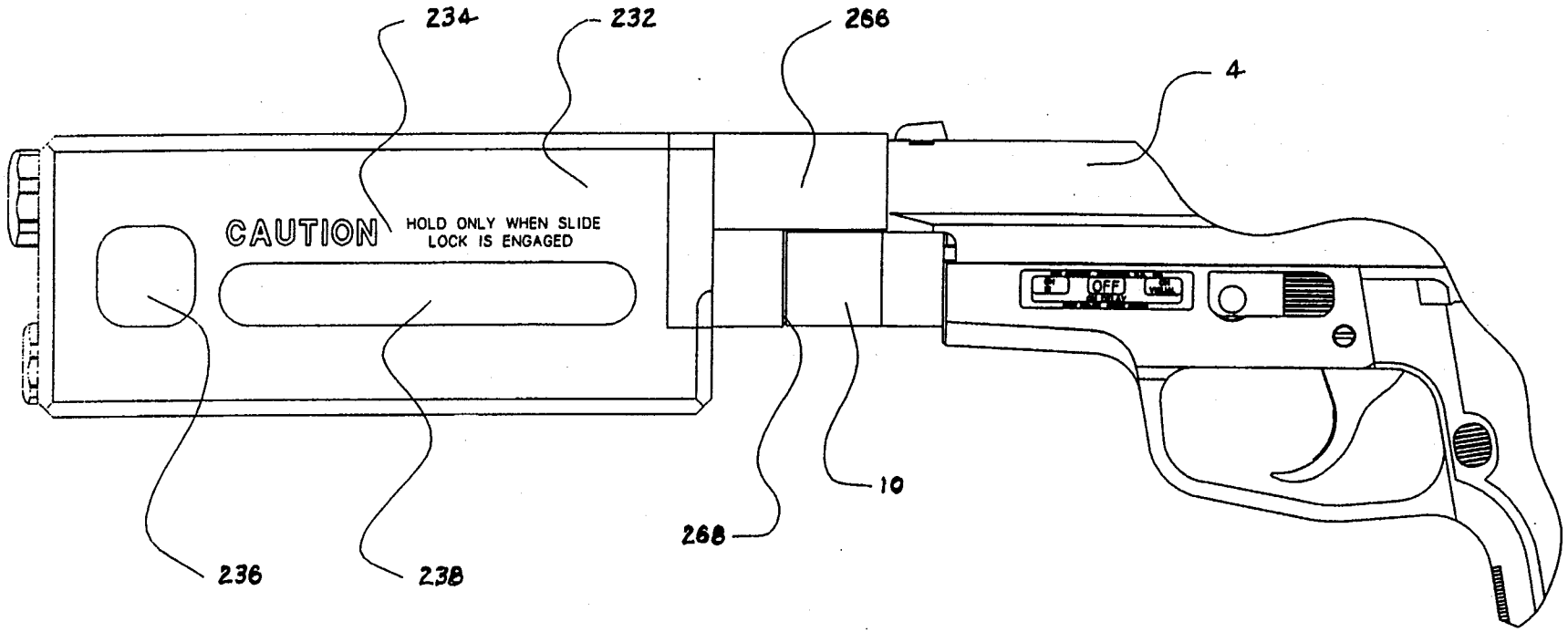
FIG. 13 is a side view of the silencer and laser sight in place on a typical autoloading handgun.

FIG. 13 is a side view of the silencer and laser sight in place on a typical autoloading handgun. A slide lock is fitted to the firearm. Once the autoloading handgun is fitted with a slide lock, slide 4 will not recoil to eject the spent cartridge and strip a new cartridge from the magazine 101 and load it in the firing chamber. As mentioned above, if the firearm were to "autoload" when fitted with silencer 232, it would substantially defeat the purpose of the silencer. Warning 234 is place on silencer 232 to caution the shooter against holding silencer 232 when the slide lock is not engaged since silencer 232 will recoil along with laser 10 which anchored to slide 4.

However, once the slide lock is in place, the firearm may be used as "pump action" weapon where the shooter places his/her hand on thumb indent 236 and finger indent 238 (note matching indents are on the opposite side) to quietly move slide backward to eject the spent cartridge and place a new one in the firing chamber.

Figure 14:
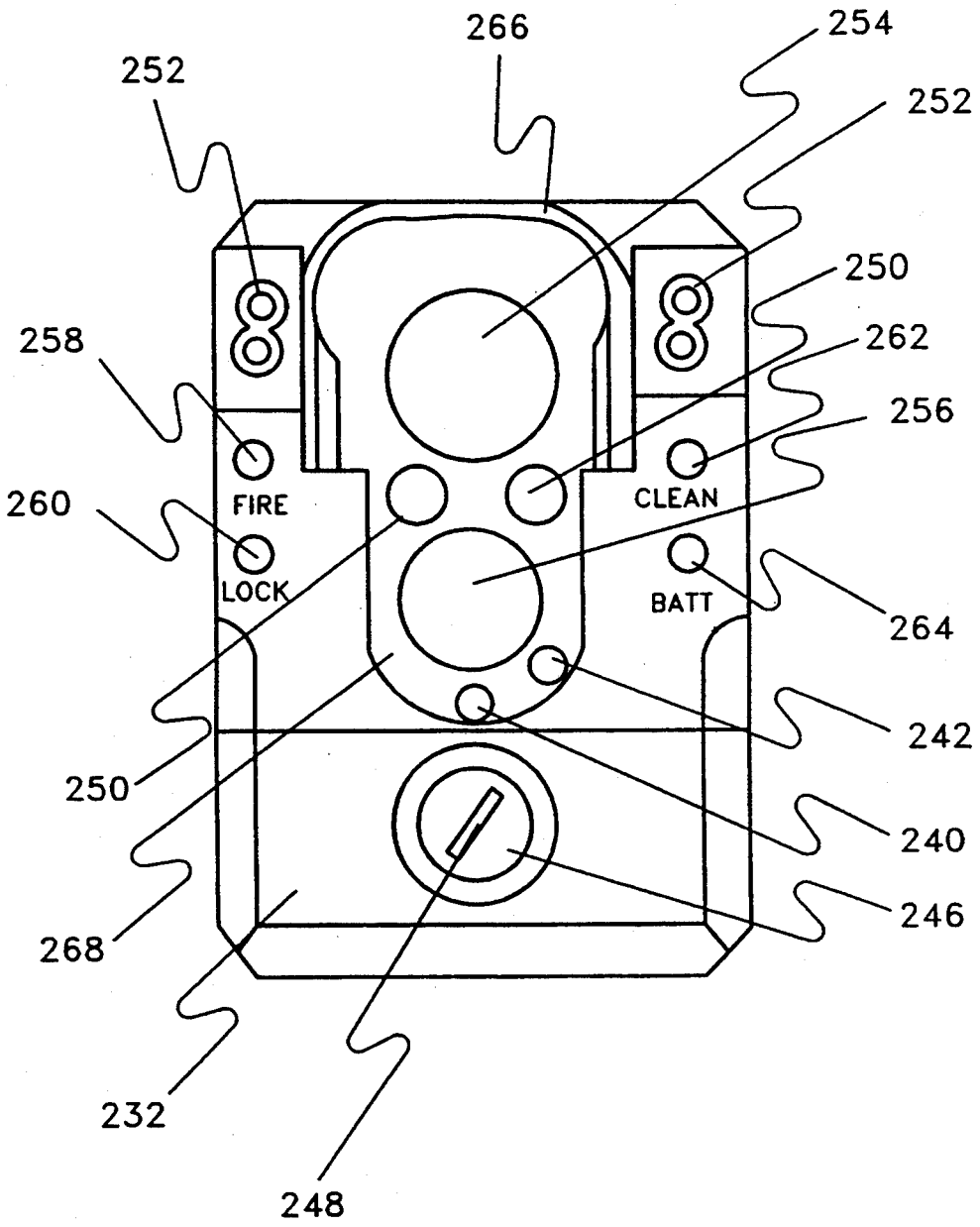
FIG. 14 is a rear view of the silencer in accordance with the invention.

FIG. 14 is a rear view of the silencer in accordance with the invention. A pair of numeric displays 252 provide the number of rounds left to fire. The preferred LED display is LA301YB single digit display as manufactured by ROHM. The display is preset at the factory to the standard magazine size sold with the autoloader. However, the user can change this number to accommodate various clip sizes. Hood 266 seats over grooves 216 so that it firmly engages top 218 on chassis 12 of the laser sight. The profile of face 244 matches that of the front face of chassis 12 of the laser sight as shown in FIG. 12. Holes 250 allow the laser diode 58 to shine through. Opening 256 is a clearance hole for spring recoil guide (now modified to a battery pack to operate the laser sight) to fit when the firearm slide 4 is slid back. Opening 254 is for barrel 30, again when slide 4 is slid to the rear. Communication opening 240 allows LED 212 to communicate with its corresponding detector.

Access to the battery compartment is provided by battery plug 246 which can be unscrewed via slot 248 using a coin.

Warning LED 260 is used to indicate a spent round in the firearm. Recall that to obtain maximum sound reduction using a silencer, the autoloading feature of having the slide automatically eject the spent round and insert a new one must be temporarily disabled. Therefore, it is possible for the user to forget that a used cartridge is still in the firearm. LED 260 warns of this condition.

Warning LED 258 tells the shooter that a round is in the firing chamber. Warning LED 262 is used to indicate to the shooter when a pre-set number of rounds have been fired, thus requiring that the silencer be cleaned.

Finally, warning LED 264 indicates that the batteries are low and should be replaced.

Pin 242 is used to anchor the silencer to the laser sight module via opening 230 in chassis 12. Before pin 242 is locked into position, it sits flush with surface 244.

Figure 15:
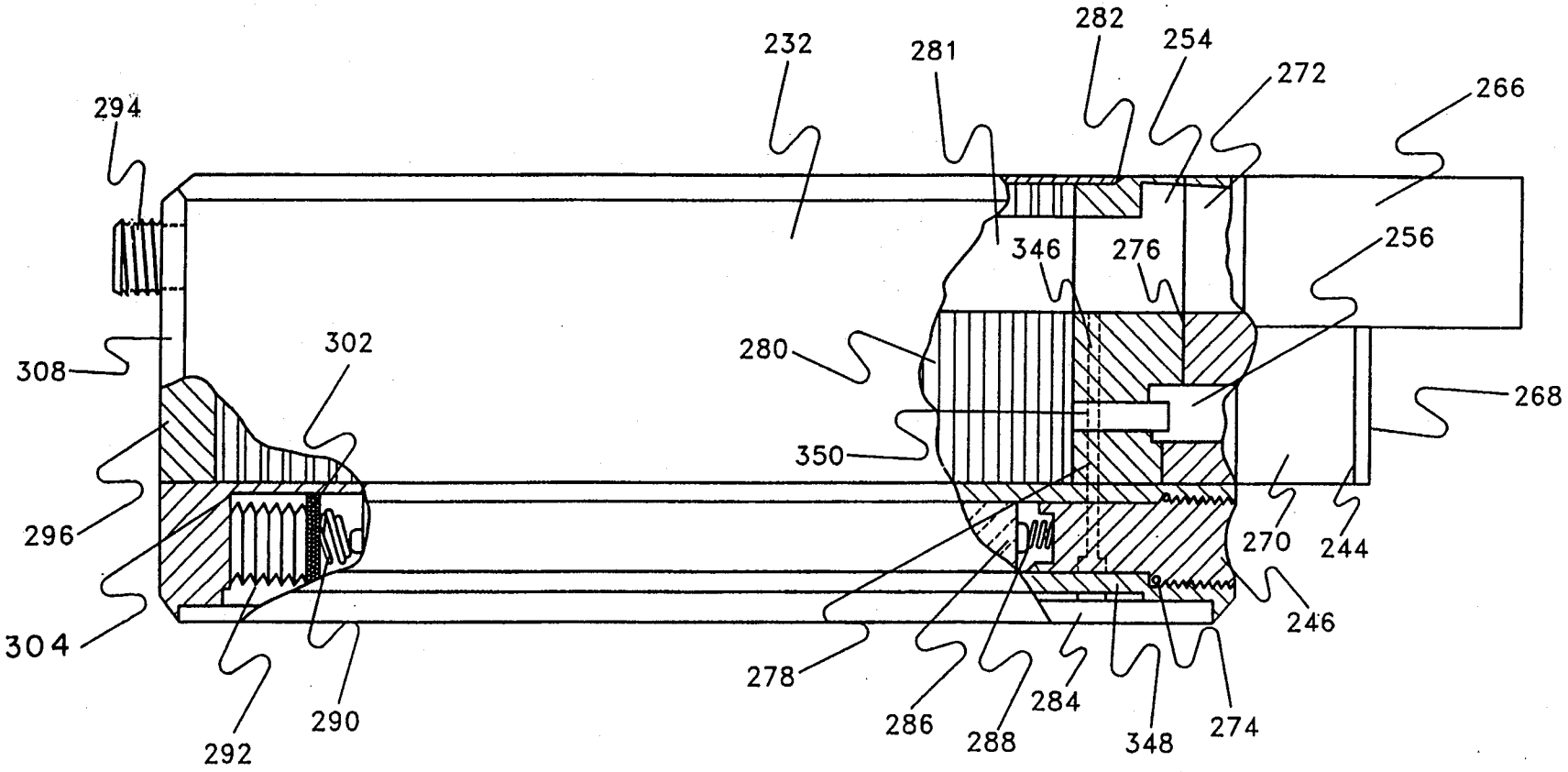
FIG. 15 is a side view of the silencer with cut-away views of the components.

FIG. 15 is a side view of the silencer with cut-away views of the components. Gasket 268, formed of material capable of withstanding high temperatures and pressure, covers surface 244. The purpose of gasket 268 is to keep the powder gases leaking from the joint where the laser sight module joins the silencer. Silencer mounting chassis 270 corresponds in cross-sectional profile to laser sight chassis 12. The preferred embodiment is for the laser sight module to be mounted first since a rigid mounting is critical to accurate sighting. However, assuming that the silencer could provide a rigid mounting platform relative to the barrel, the laser sight module could be mounted on the front of the silencer.

Clearance opening 272 provides space for the barrel 30 to occupy when slide 4 is slid back. Bore 254 is sized to accommodate either 45 caliber, 40 caliber or 9 mm ammunition. The interior of silencer 232 is lined with honeycomb 280. Honeycomb 280 is preferably ⅛ inch cell titanium as manufactured by Kentucky Metals of New Albany, Ind. Bore 281 through honeycomb 280 is sized to correspond to the caliber of ammunition that will be fired.

Fiber optic cable 346 extends into bore 254 so that a flash can be detected. The flash is then fed back to circuit board 284 which has LED 348 connected to it (shown in FIG. 18). Proximity switch 350 is positioned within opening 256. Switch 350 is also wired to board 284. In this manner, every time the gun is fired, the microprocessor on board 284 records the discharge. Every time the slide is slid back, battery pack 14 will pass by switch 350, thereby activating it. The microprocessor uses this information to display the number of rounds remaining, accumulate the total rounds fired (used to signal when cleaning is required), indicate whether a round is within the firing chamber and whether the round in the firing chamber is live or spent.

Battery plug 246 has spring 288 attached to it and provides the ground connection for batteries 286. The metal parts of the silencer, laser sight and handgun constitute ground for the circuit. Plug 246 is sealed against water leakage by O-ring 274. Batteries 286 are preferably 2 commercially available AAA extended duty-type. Spring 290 is connected to the positive end of batteries 286. Spring 290 is attached to circuit board 302. Springs 288 and 290 serve also as shock absorbers to protect the batteries against the recoil of the firearm when fired.

Battery housing 304 is welded to member 278 and outer housing 283 by weld 282. RTV joint 276 is used to further protect against moisture entering the silencer.

Cover 296 provides access to the interior of silencer 232 to permit cleaning. Cover 296 is held in place by threaded member 294 and groove 298 which mates with step 300 in housing 304.

Figure 16:
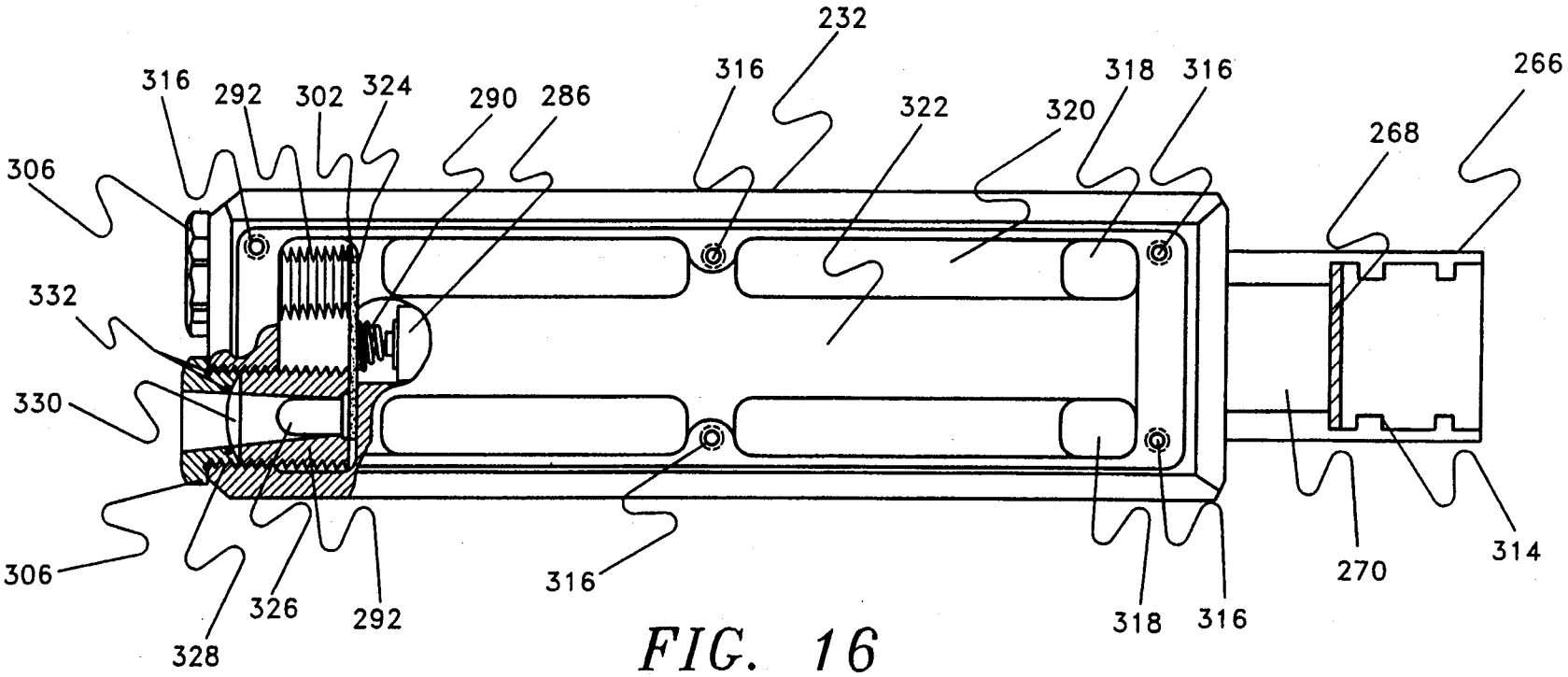
FIG. 16 is a bottom view of the silencer with the flexible membrane circuit board removed.

FIG. 16 is a bottom view of silencer 232 with flexible membrane circuit board 284 removed. Hood 266 has steps 314 which fit in grooves 216 on chassis 12 of the laser sight module. Gasket 268 covers the entire surface 244 (shown in FIG. 14). Board 284 attaches to silencer 232 via tap holes 316. Access holes 318 permit circuit boards 334 to be place in position so that numeric displays 252 and LEDs 258 to 264 can be viewed from the rear end of silencer 232. Openings 320 reduce the weight of the apparatus and provide a pocket for the circuitry on board 284. Stud 292 urges circuit board 302 against surface 324 and locks board 302 in place. This arrangement acts a locating means for centering spring 290. Flashlights 326 (only one shown for clarity) provide a high intensity red light and a high intensity infra-red light according to which flashlight 326 is selected.

Stud star nut 306 and stud 292 forms the housing for the visible and infra-red flashlights that are mounted in battery housing 304 of silencer 232. As shown in the cut-away view, stud 292 has a hollow cone-shaped cavity which serves to house lenses 328. O-rings 332 seal the glass lens 328 and stud 292 in silencer 292 to seal against moisture entering the system.

Figure 17:
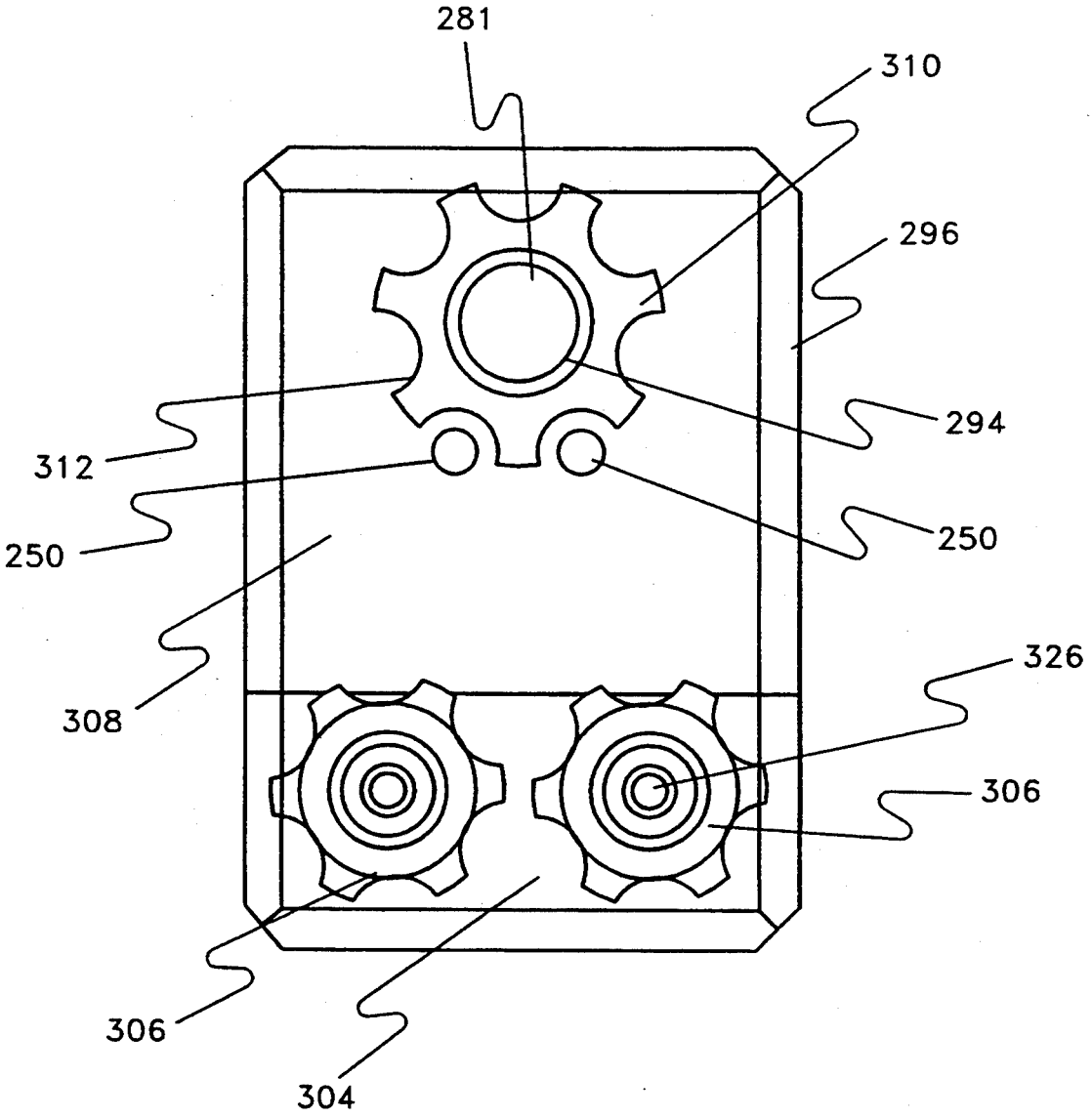
FIG. 17 is a front end view of the silencer.

FIG. 17 is a front end view of silencer 232. Threaded retaining nut 310 is screwed onto member 294 thus holding cover 296 in place. Laser diode 250 exit from cover 296 as shown. To prevent nut 31 0 from interfering with the light transmission, radiuses 312 are provided as well as a positioning mechanism discussed in FIG. 19. Note that surface 308 of silencer 232 could have one or more laser diodes directly mounted rather than having the light shine through from the rear mounted laser sight module. While the two module system is preferred due to the stability requirements of having the laser diodes accurately fixed relative to the position of the barrel, front mounted laser diodes on the silencer would be a reasonable alternative.

Figure 18:
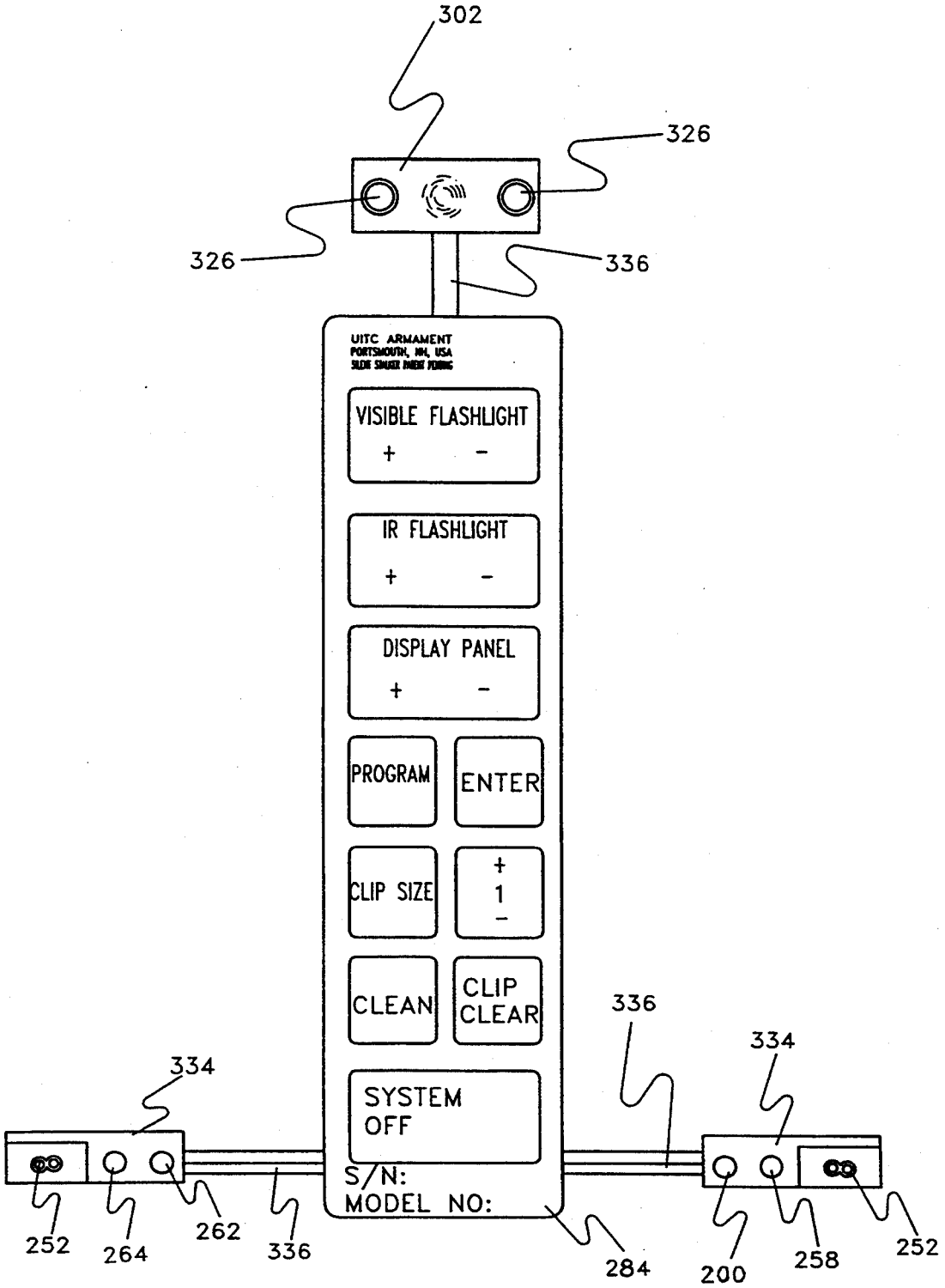
FIG. 18 is a detail of the flexible membrane circuit board.

FIG. 18 is a detail of the flexible membrane circuit board 284 with attached boards **334*a* and 334*b*. Numeric display 252, LED 258 and LED 260 is attached to board 334*a*. Board 334*a* is connected to the main section of board 284 via flexible connector 336*a*. Another numeric display 252, LED 262 and LED 264 are attached to board 334*b* via flexible connector 336*b*. As previously discussed, this enables boards 334*a* and 334*b* to be fed through holes 318 to be place in viewing position on silencer 232. Board 302 is connected to board 284 via flexible cable 336*c*. Board 302 houses the two flashlights 326**.

The programmable controls which are activated by membrane switches are as shown. Board 284 and its associated microprocessor and circuitry process the signal information received from gun, laser signal module, proximity switch 350 and LED 348. Membrane switches, as shown, allow the shooter to select between visible and infra-red flashlights, program the clip size, re-set the cleaning counter, etc.

Figure 19:
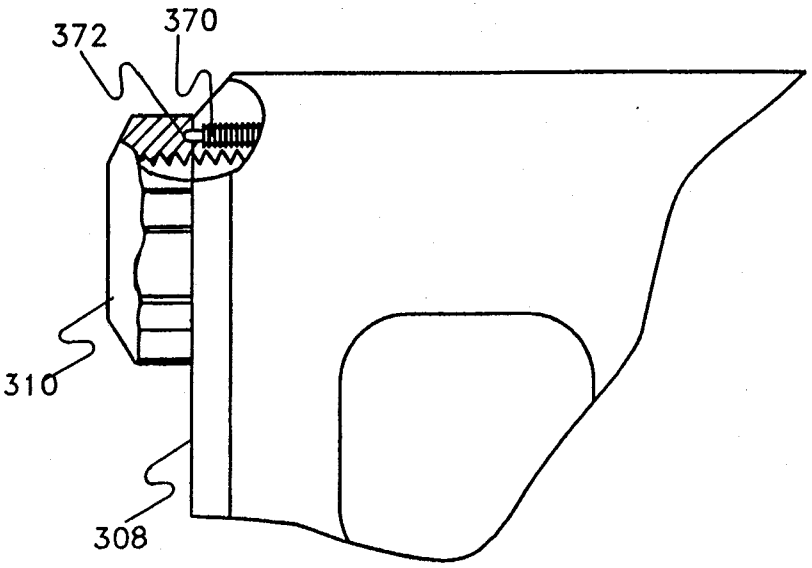
FIG. 19 is a detail of the star-shaped locking nut.

FIG. 19 is a detail of the star-shaped locking nut 310. Detent 372 is provided on each arm of the star on its back surface. Spring plunger 370 is fitted into surface 308 of the silencer immediately adjacent to nut 310. In this manner, nut 310 will be indexed to those positions which correspond to the arms of nut 310 being away from the openings which have diodes 250 shining through.

Figure 20:
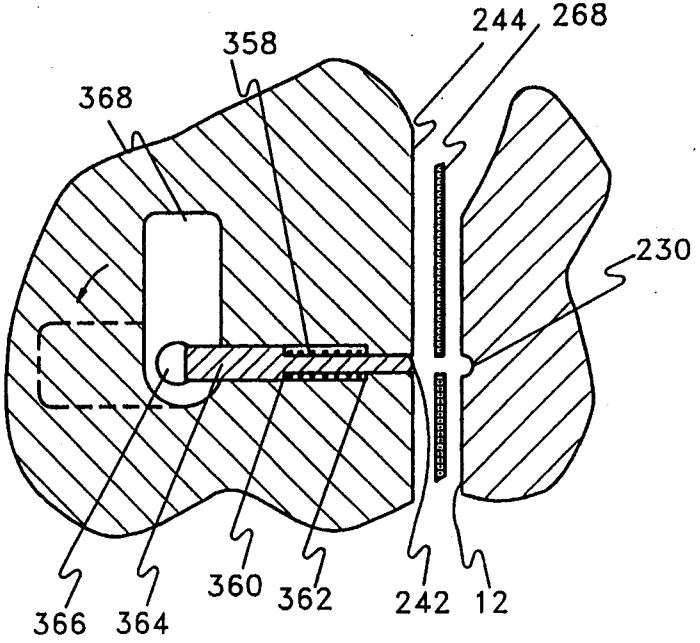
FIG. 20 is a detail of the cam locking system that holds the silencer firmly attached to the laser sight module.

FIG. 20 is a detail of the cam locking system that holds silencer 232 firmly attached to the laser sight module. Locking lever arm 368 is attached to cam 366. When arm 368 is moved to its lower position, as shown by the dotted line, cam 366 urges follower 364 against seat 360. Spring 358 is thereby compressed. Pin 242 extends from cavity 362 into pin receiver opening 230 which is located on chassis 12 of the laser sight module. In this manner, silencer 232 is locked firmly in place on the laser sight module without the use of tools. Since information is transmitted from the gun to the laser sight module to the silencer by light, no other connections are required. Thus, the unit can be quickly and conveniently attached and subsequently removed if desired.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A silencer for an autoloading handgun that attaches to a laser sight module which is attached to said handgun, said handgun having a barrel and a spring recoil guide, a trigger, a frame, a magazine, a slide having a cross-sectional profile with a front face having two holes therein, with one hole corresponding to the diameter of the barrel and the other hole corresponding to the diameter of the spring recoil guide, said silencer comprising:

an attachment face, having a cross-sectional profile corresponding to the cross-sectional profile of said laser sight module, said attachment face having a first opening corresponding to the barrel of said handgun, a second opening corresponding to the spring recoil guide of said handgun, a third opening for light communication between said laser sight module and said silencer, at least one diode opening to allow laser diode light produced by said laser sight module to shine therethrough;

a microprocessor optically connected to said laser sight module and said handgun wherein said microprocessor produces a first output signal corresponding to the number of rounds left to fire in the magazine of said handgun, a second output signal that corresponds to an accumulative total of rounds fired through said handgun, a third output signal that corresponds to whether a cartridge is present within the firing chamber of said handgun, a fourth output signal that corresponds to whether a cartridge within the firing chamber of said handgun has been fired, means for substantially reducing the noise associated with the firing of a cartridge in said handgun.

2. The silencer of claim 1 further comprising a laser sight chassis, having a cross-sectional profile corresponding to the cross-sectional profile of the slide of said handgun, said chassis having a front face, a back face, and having two holes extending therethrough from the back face to the front face of said chassis, with the holes corresponding to the holes in the front face of the slide of said handgun, with said chassis having at least one light source wherein the light of said light source is emitted from the front face of said chassis, and with the back face of said chassis securely mounted on the front face of the slide of said handgun.

3. The silencer of claim 1 further comprising an integral battery operated flashlight.

4. The silencer of claim 3 wherein said integral battery operated flashlight provides and infra red beam and visual red beam.

5. The silencer of claim 4 wherein said means for substantially reducing the noise emitted by said firearm when a cartridge is fired therein further comprises a metallic honeycomb.

6. The silencer of claim 5 wherein the metal of said honeycomb is titanium.

7. The silencer of claim 4 further comprising at least one numeric digital display, connected to said first output signal, to visual indicate the number of rounds left in the magazine of said handgun.

8. The silencer of claim 7 further comprising an LED connected to said second output signal, to indicate that the silencer needs cleaning.

9. The silencer of claim 8 further comprising a second LED connected to said third output signal, to indicate that a cartridge is in the firing chamber of said handgun.

10. The silencer of claim 9 further comprising a third LED, connected to said fourth output signal, to indicate that the cartridge within the firing chamber of said handgun has been fired.

11. The silencer of claim 10 further comprising a fourth LED to indicate that the batteries powering said silencer need to be changed.

* * * * *